United States Patent [19]

Tapper

[11] Patent Number: 5,014,616

[45] Date of Patent: May 14, 1991

[54] SCAVENGER FOR A GRAVURE PRINTING PRESS

[75] Inventor: Lee C. Tapper, Winona Lake, Ind.

[73] Assignee: R.R. Donnelley & Sons Company, Chicago, Ill.

[21] Appl. No.: 317,759

[22] Filed: Mar. 2, 1989

[51] Int. Cl.[5] ..... B41F 9/10; B41F 9/16

[52] U.S. Cl. ..... 101/153; 101/169

[58] Field of Search ..... 101/152, 153, 157, 169, 101/366, 365; 34/155, 175, 140

[56] References Cited

U.S. PATENT DOCUMENTS 1,196,090 8/1916 Doyle .
2,022,635 11/1935 Durham .
2,040,961 5/1936 Stouch .
2,126,778 9/1938 Horton .
2,141,978 12/1938 Greenhill .
2,256,515 9/1941 Brueshaber .
3,108,539 10/1963 Champion et al. .
3,264,673 8/1966 Scott .
3,624,860 12/1971 Grimston et al. .
3,829,927 8/1974 Boyland .
3,988,988 11/1976 Sable .

FOREIGN PATENT DOCUMENTS 449112 6/1936 United Kingdom ..... 101/157
477752 1/1938 United Kingdom ..... 101/157

*Primary Examiner*—J. Reed Fisher
*Attorney, Agent, or Firm*—Wood, Phillips, Mason, Recktenwald & VanSanten

[57] ABSTRACT

A gravure printing press includes a scavenger located adjacent a pinch formed by an impression roller and a printing cylinder. The scavenger captures air drawn to the printing clinder which has become laden with solvent from ink on an outer surface of the cylinder, to minimize the dispersion of the solvent laden air to the area surrounding the press.

3 Claims, 5 Drawing Sheets

FIG. 3
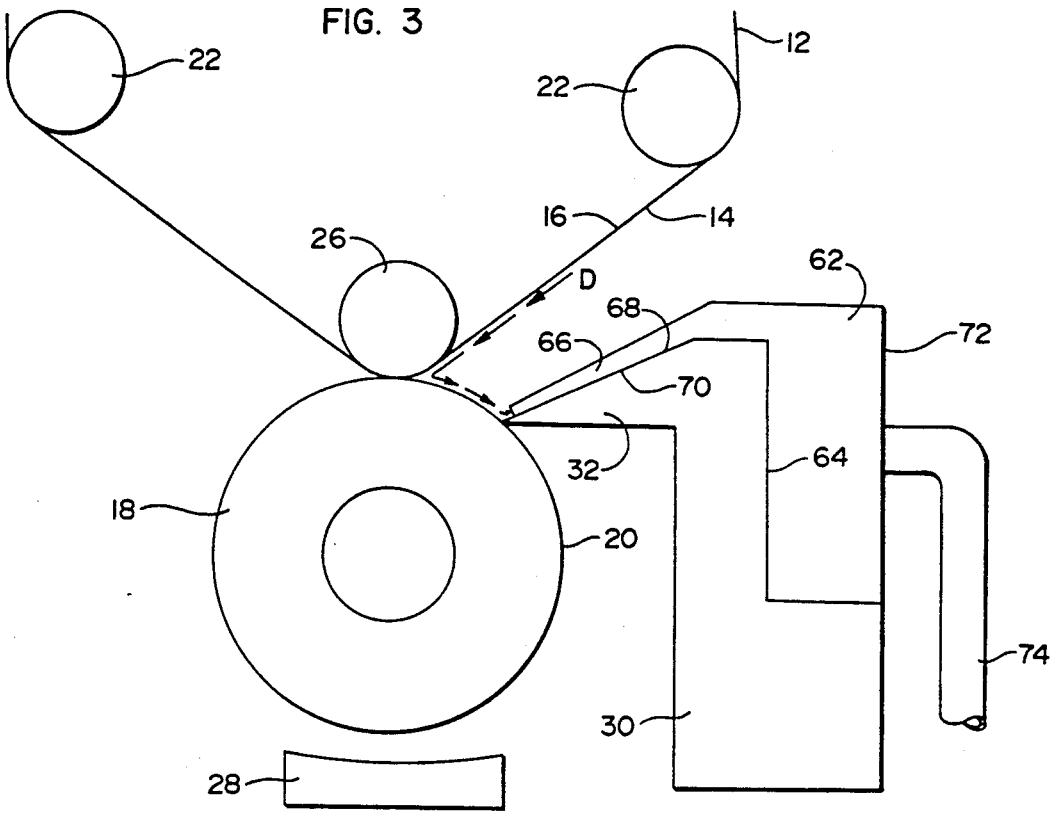
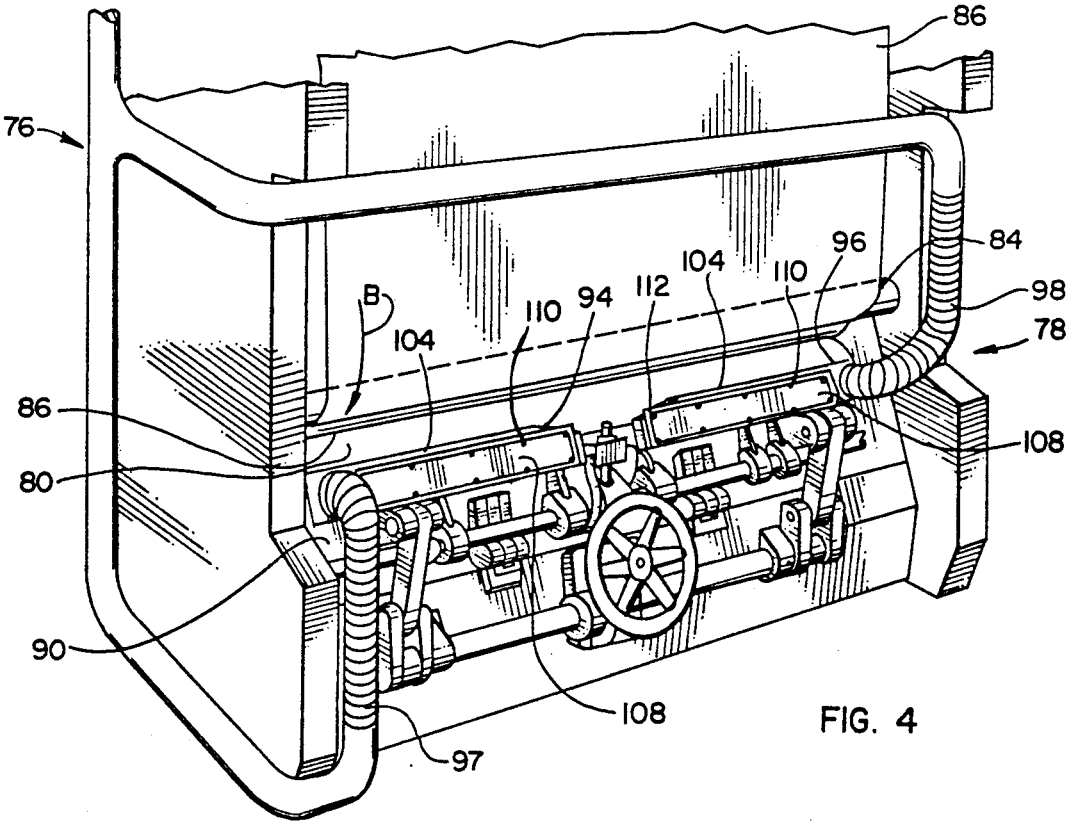
FIG. 4

86
94
120
100
101
102
134
136
132
138
140
141
118
122
90
93
92
124
126
128
130
88
D
82
91
80
A
B
6
97
126
140
138
100
94
100
97
6
88
80
A
82
91
126
B
93
93
92
90
118
122
102
101
134
136
132
138
140
141
138
100
120
94
88
D
128
130
91
82
80
124
132
128

SCAVENGER FOR A GRAVURE PRINTING PRESS

FIELD OF THE INVENTION

This invention relates to a printing press, and more particularly, to a gravure printing press including an ink solvent scavenger.

BACKGROUND OF THE INVENTION

A gravure printing press includes a rotatable printing cylinder having an outer surface onto which is deposited an ink having a volatile solvent for transfer to a web to be printed, and a doctor blade in contact with the cylinder outer surface for removing excess ink from the cylinder.

During the printing operation, air is drawn to the printing cylinder through the movement of the web in the direction of the cylinder. As a result thereof, the air becomes laden with solvent from the ink on the cylinder and escapes from the doctor blade side of the press.

In an attempt to minimize the dispersion of solvent laden air throughout the press area, prior art presses have utilized a scavenger located several feet from the printing cylinder at an upper section of the press. Barrier curtains have been hung vertically from the scavenger substantially to the doctor blade to contain the spread of fumes.

Notwithstanding the incorporation of the abovementioned provisions, solvent laden air nonetheless escapes from around the scavenger to the area surrounding the press.

The present invention is directed to a gravure printing press including a scavenger which overcomes the above-mentioned problem associated with prior art scavengers.

SUMMARY OF THE INVENTION

It is an object of this invention to provide a gravure printing press including a scavenger adjacent the cylinder and mounted on top of a blade table for capturing air drawn to the cylinder which has become laden with solvent from the ink on the cylinder to minimize the dispersion of solvent laden air to the area surrounding the press.

In accordance with this invention, the printing press includes a rotatable printing cylinder with an outer surface. A rotatable impression roller forms a pinch with the cylinder. Means are provided for directing a moving web to be printed through the pinch wherein the movement of the web draws air to the printing cylinder. An ink fountain is provided for supplying ink having a volatile solvent to the surface of the cylinder for transfer to the web, and a scavenger is located adjacent to the pinch for capturing air drawn to the cylinder which has become laden with solvent from the ink on the cylinder to minimize the dispersion of solvent laden air to the area surrounding the press.

A feature of this invention is that the scavenger comprises a chamber having an inlet substantially at the surface of the printing cylinder.

Another feature of this invention is that the scavenger chamber is located between a doctor blade for removing excess ink from the cylinder and the pinch.

A further feature of the invention is that the scavenger is mounted on the table which carries the doctor blade.

Yet a further feature is that the scavenger includes a chamber extending the length of the printing cylinder.

Another feature is that the scavenger comprises first and second chambers which each include a plurality of nozzles.

Yet another feature of this invention is that an exhaust fan is provided, and a duct connects the scavenger with the exhaust fan. The exhaust fan supplies a suction for drawing the solvent laden air from the scavenger.

Further features and advantages of this invention will readily be apparent from the specification and from the drawings.

BRIEF DESCRIPTION OF THE DRAWINGS

FIG. 3 is a diagrammatic end elevational view, on an enlarged scale, illustrating the scavenger of the present invention, taken generally along line 3—3 of FIG. 2;

FIG. 4 is a fragmentary, perspective view of a gravure press including a scavenger according to a first embodiment of the present invention;

DESCRIPTION OF THE INVENTION

It is to be understood that the scavenger of the present invention is useful particularly with gravure presses wherein the solvent is extremely volatile and constitutes approximately 80% of the ink. In the case of offset presses, the solvent constitutes only about 45% of the ink. Further, the offset ink solvent has a much higher boiling point so that there is little evaporation from the press cylinders.

Figure 1:
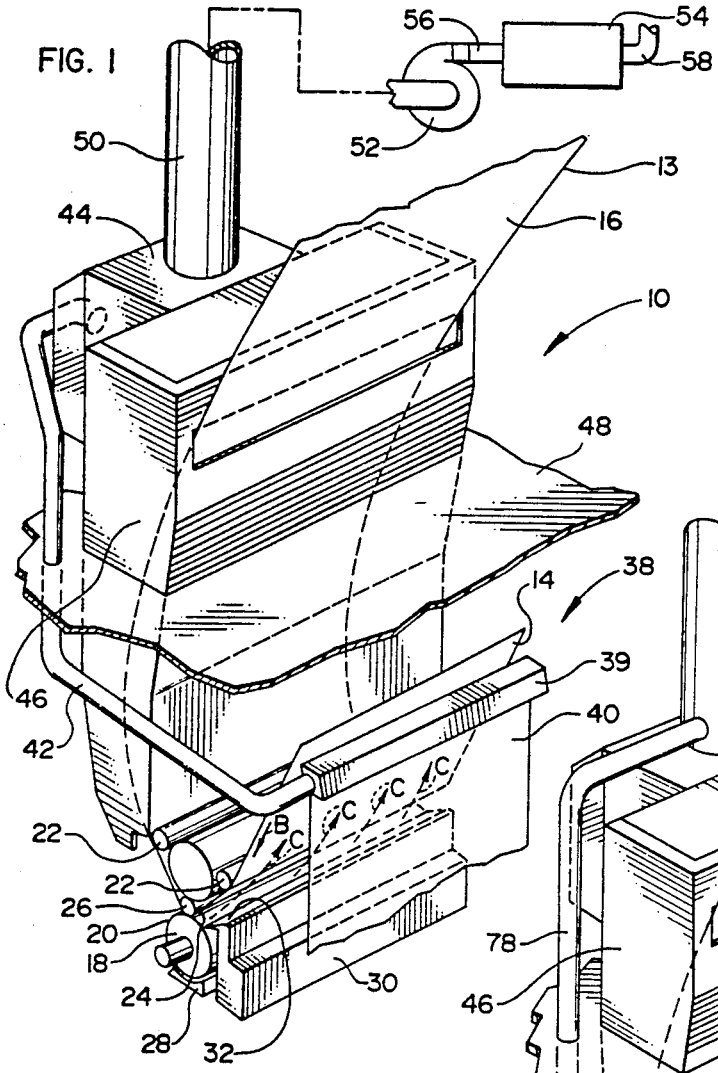
FIG. 1 is a schematic, perspective view of a gravure printing press including a scavenger according to the prior art.

Referring to the drawings in detail, a gravure press unit, generally designated 10, including a scavenger 12 according to the prior art is shown in FIG. 1.

It is to be understood, of course, that the gravure press unit 10 is one of eight identical press units which together comprise a press wherein four colors are used and wherein a web 13, as shown in FIG. 1, is printed on first and second surfaces 14, 16. The gravure press 10 in FIG. 1 is illustrative of a press applying one of the colors on one of surfaces 14 of the web 13.

As shown in FIG. 1, the gravure press 10 includes a printing cylinder 18, having an outer surface 20, rotatable in the direction of arrow A.

A plurality of rollers 22 direct the web 13 in the direction of arrow B through a pinch 24 formed by a rotatable impression roller 26 and the cylinder 20.

The gravure press 10 includes an ink fountain 28 extending the length of the cylinder 18 for supplying ink having a volatile solvent to the outer surface 20 of the cylinder 18 for transfer to the surface 14 of web 13.

Further, the gravure press 10 includes a blade table 30 extending the length of cylinder 18. The blade table 30 includes a doctor blade 32 in contact with the cylinder surface 20 for removing excess ink therefrom.

A scavenger 38 according to the prior art is shown at an upper section of the press. A barrier curtain 40 is connected to scavenger 38 and extends therefrom substantially to the doctor table 30 to contain the solvent laden air escaping from the doctor blade side of the cylinder in the direction of arrows C. The scavenger 38 includes a chamber 39, for the capture of solvent laden air traveling in the direction of arrows C, connected to a duct 42. The duct 42, in turn, is connected to a portion 44 of a dryer 46 for drying the ink on the web 13 which travels through the dryer 46. Although not shown, portion 44 of dryer 46 includes a recirculation fan which provides the suction for scavenger 38. As shown in FIG. 1, the dryer 46 extends from the lower portion of the press unit 10 to an upper portion separated from the lower portion by a deck 48.

The dryer 46 has a duct 50 which is connected to a dryer exhaust fan 52, which, in turn, is connected to a solvent recovery system 54 by means of a duct 56. In turn, the solvent recovery system 54 is connected to a chimney or the like (not shown) by means of a duct 58, for releasing the remaining dryer exhaust to the atmosphere.

Figure 2:
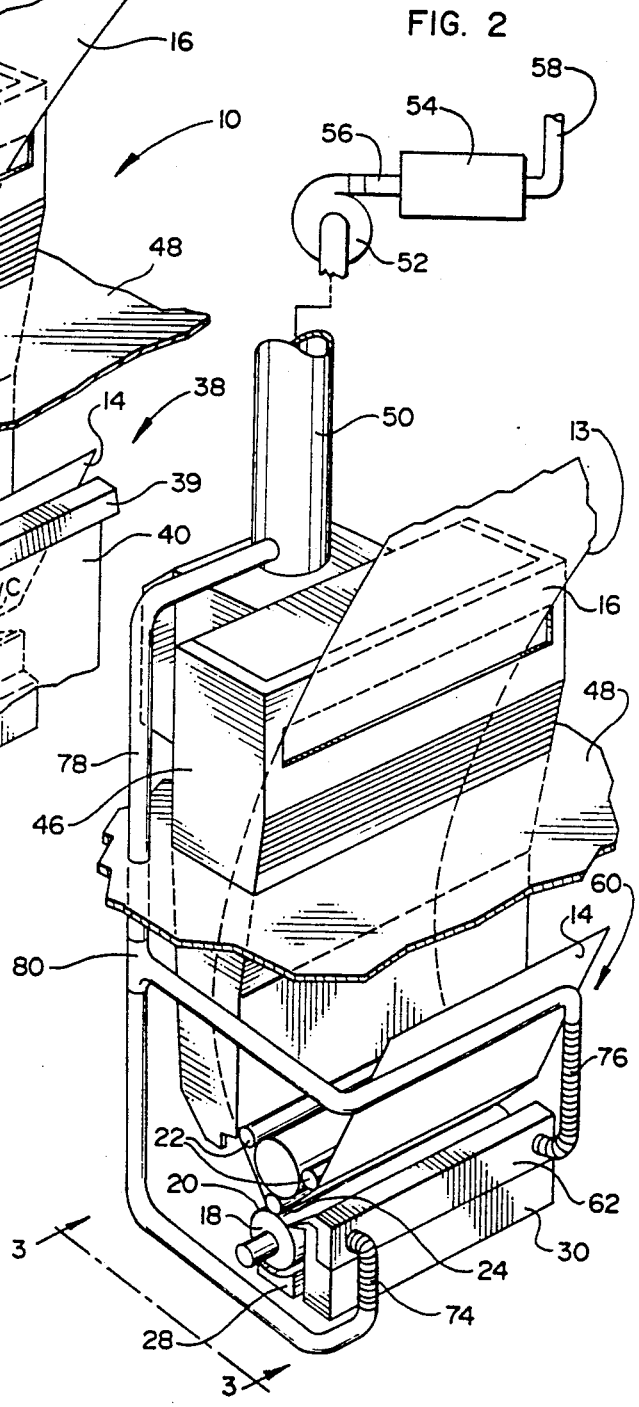
FIG. 2 is a schematic, perspective view of a gravure press including a scavenger according to the present invention.

A gravure press unit 10 including a scavenger, generally designated 60, according to the present invention is schematically shown in FIG. 2. The press unit 10 includes all of the elements described in FIG. 1 except for the scavenger 38 and curtain 40. Instead, the scavenger 60 is mounted on blade table 30. As better shown in FIG. 3, scavenger 60 includes a chamber 62 extending the length of cylinder 18. The chamber 62 has a front wall 64 from which an inlet portion 66 extends. The inlet portion 66 extends the length of the cylinder 18, substantially to the surface 20 of cylinder 18.

The scavenger 62, as shown in FIG. 3, is mounted on top of the blade table 30 such that a bottom surface 68 of inlet portion 66 superposes a top surface 70 of doctor blade 32.

The chamber 62 of scavenger 60 includes a back wall 72 to which two flexible ducts 74, 76 are connected, as shown in FIG. 2. The ducts 74, 76 are, in turn, connected to a duct 78 which includes a regulating damper 80. Instead of being connected to the recirculation fan of dryer 46, as in FIG. 1, duct 78 is connected to exhaust duct 50 of dryer 46.

Referring to FIGS. 2 and 3, a method of capturing solvent laden air according to the present invention will be described.

As the web 13 travels into the press 10 in the direction of arrow B, a boundary layer of air is pulled along and flows in the direction of arrows D. As the web 13 enters the pinch 24 formed by the impression roller 26, and cylinder 18, the air is peeled away from the surface 14 of web 13. Once peeled off, the air now flows over the outer surface 20 of the cylinder 18 and picks up solvent from the ink to remove solvent laden air. Since the doctor blade 34 is in contact with the surface 20 of cylinder 18, the doctor blade 34 acts as a barrier to the flow of air. As a result, the air is forced to travel along the top surface 50 of doctor blade 34 towards the scavenger inlet 66.

Since the dryer exhaust fan 52 supplies a suction to chamber 62 and, therefore, to inlet portion 66, the solvent laden air is captured.

Additionally, the dryer exhaust fan 52 supplies a suction for the capture of exhaust from dryer 46. Although not shown in FIGS. 1 or 2, it is noted that exhaust fan 52 is ducted to three other dryer units in addition to dryer unit 46.

Once the solvent laden air is captured, it flows through ducts 74, 76, and then through duct 78, duct 50, exhaust fan 52, and duct 56 to the solvent recovery system 54 wherein the solvent is recovered from the solvent laden air. The exhaust air from the recovery system flows through duct 58 and is dispersed into the atmosphere.

In a like manner, the dryer exhaust flows through conduit 50, exhaust fan 52, conduit 56, and then through the solvent recovery system 54 wherein solvent is recovered from the dryer exhaust. The remaining exhaust is dispersed to the atmosphere via conduit 58.

Figures 5, 6, 11:
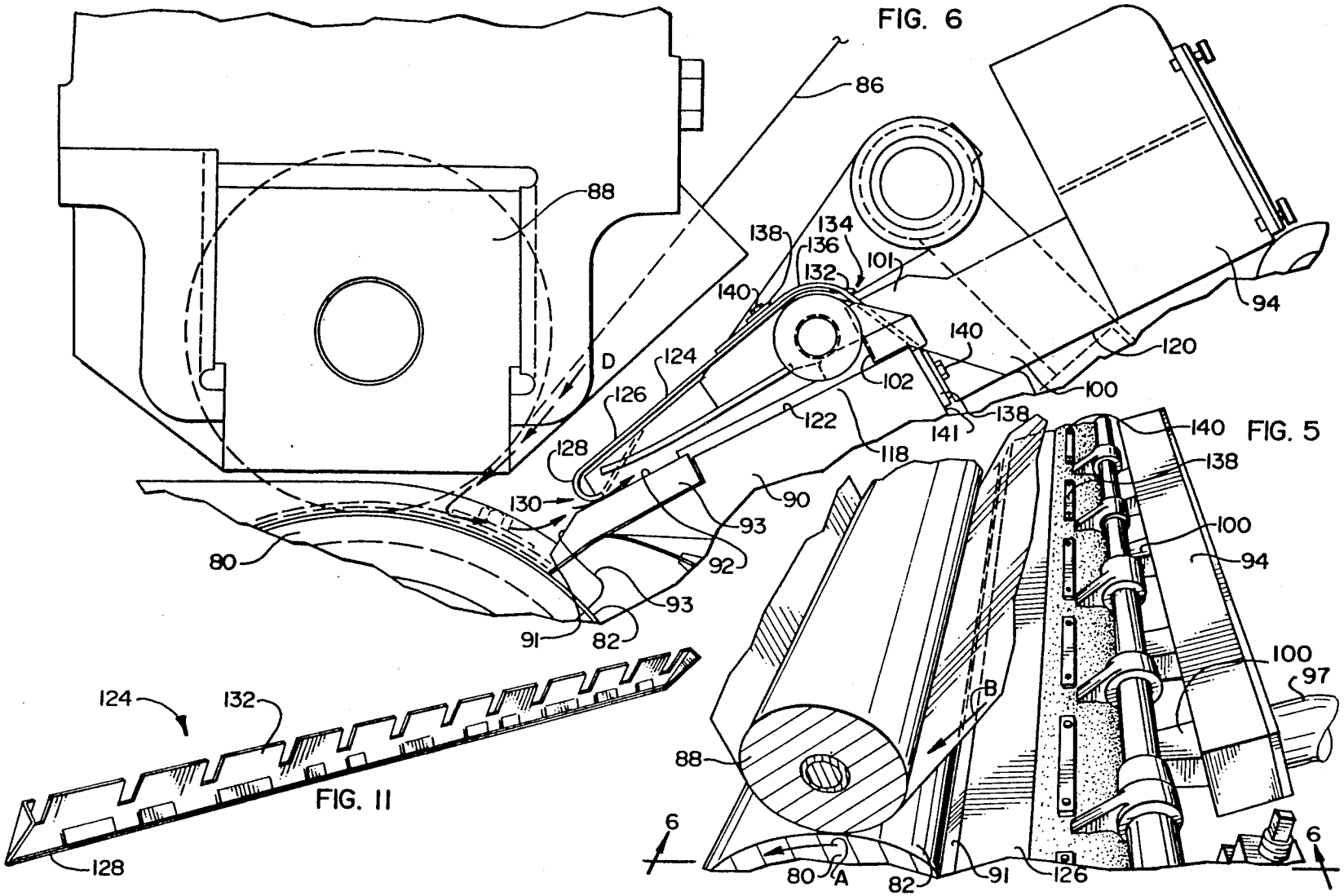
FIG. 5 is a fragmentary, perspective detail view of the cylinder and impression roller of the gravure press of FIG. 4 illustrating the position of the scavenger with respect to the printing cylinder.
FIG. 6 is a fragmentary, sectional view illustrating the scavenger taken generally along line 6—6 of FIG. 5.
FIG. 11 is a perspective view of a doctor blade cover of the gravure press depicted in FIGS. 4 and 5.

FIGS. 4–11 illustrate a first embodiment of the invention as incorporated in a Motter press. The gravure press unit, generally designated 76, has a scavenger 78. As shown in FIGS. 4 and 5; the gravure press 76 includes a printing cylinder 80, having an outer surface 82, rotatable in the direction of arrow A. Further, rollers (not shown) direct the web 86 moving in the direction of arrow B through a pinch formed by a rotatable impression roller 88 and the cylinder 80. Although not shown in FIGS. 4 or 5, the gravure press 76 further includes an ink fountain.

As shown in FIGS. 4 and 6, the gravure press 76 includes a blade table 90 extending the length of cylinder 80. As shown in FIG. 6, a doctor blade 91 is mounted to the blade table 90 by means of a blade clamp 93, which has a top surface 92. The doctor blade 91 is in contact with the cylinder surface 82 for removing excess ink therefrom.

Referring back to FIG. 4, it is seen that scavenger 78 comprises chambers 94, 96 extending substantially the length of cylinder 80. As shown therein, a duct 97 is connected to chamber 94 while a duct 98 is connected to chamber 96. Although not shown in FIG. 4, it is understood that ducts 97, 98 are connected to the dryer exhaust duct 50 as shown in FIG. 2.

Figure 8:
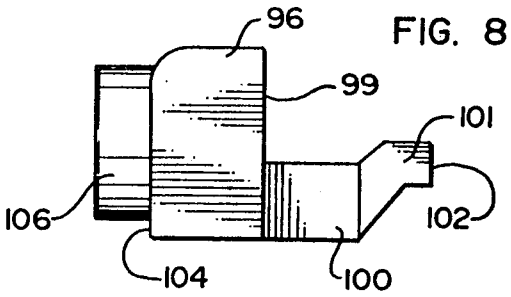
FIG. 8 is an end elevational view, taken generally along line 8—8 of FIG. 7.
Figure 7:
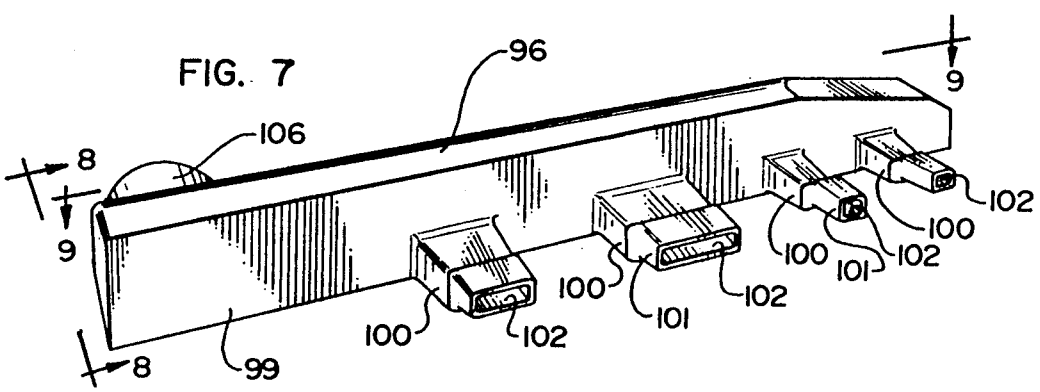
FIG. 7 is a perspective view of a scavenger chamber according to the first embodiment of the present invention.
Figure 9:
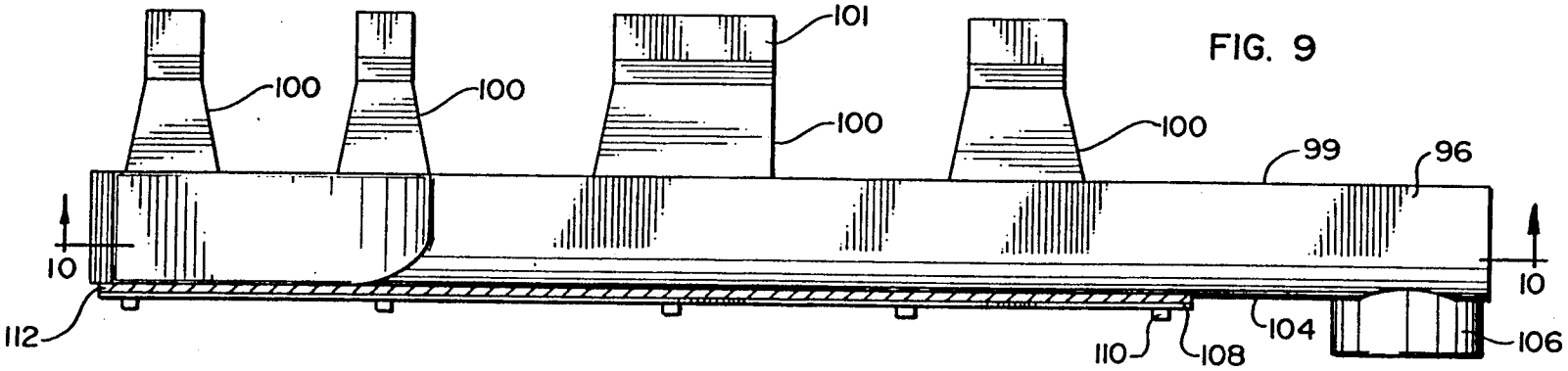
FIG. 9 is a top plan view, taken generally along line 9—9 of FIG. 7.

As shown in FIG. 5, and more particularly in FIGS. 7–10, chamber 96 includes a front wall 99 from which extends a plurality of nozzles 100. As shown in FIGS. 7 and 8, each of the nozzles 100 includes an inlet portion 101 including an inlet 102. Further, and as shown in FIG. 9, chamber 96 has a back wall 104 including an outlet 106. Additionally, the back wall 104 includes an access panel 108 which covers an opening (not shown) in back wall 104. The access panel 108 is secured to the back wall 104 by means of screws 110 and a tight seal is assured by the use of a strip of flexible material 112 such as felt or the like between back wall 104 and access panel 108.

Figure 10:
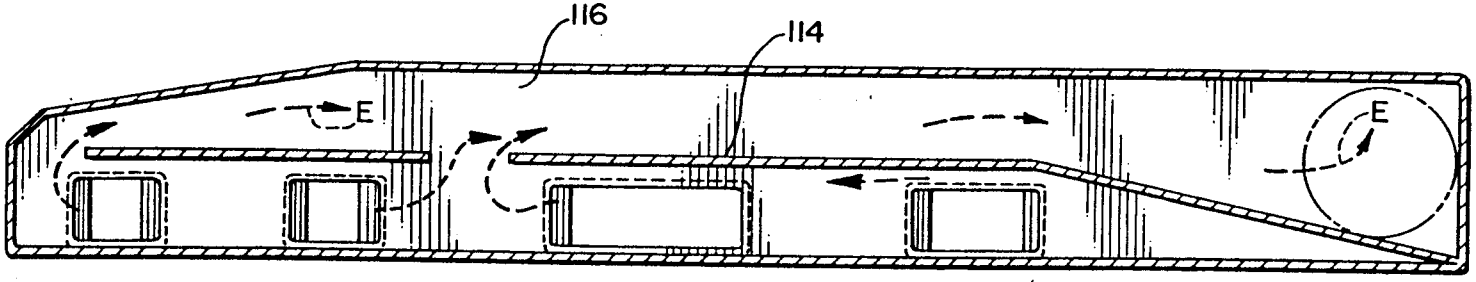
FIG. 10 is a vertical sectional view illustrating the interior of the scavenger chamber, taken generally along line 10—10 of FIG. 9.

As shown in FIG. 10, chamber 96 further includes a baffle plate 114 located within an interior 116 of chambers 94, 96. As shown therein, baffle plate 114 assures the flow of solvent laden air from the plurality of nozzles 102 to the chamber outlet 106 in the direction of arrows E.

Although reference has solely been made to the elements of chamber 96, it is noted that chamber 94 includes comparable elements.

As shown in FIG. 6, blade table 90 includes a portion 118 and a recessed portion 120 within which chamber 94 is mounted. Although not shown, it is noted that chamber 96 is mounted in a like fashion. Chamber 94 is mounted within recessed portion 120 of blade table 90 such that inlet portion 101 of nozzle 100 is seated on a top surface 122 of blade table 90.

As further shown in FIGS. 6 and 11, a doctor blade table cover 124 extends the length of printing cylinder 80. The blade table cover 124 is mounted on top of blade table 90 between chambers 94, 96 and the surface 82 of cylinder 80. The blade table cover 124 has a top surface 126, and a front portion 128 defining an inlet 130 for the flow of solvent laden air between doctor blade 91, blade clamp 93, and blade table cover 124. Further, the blade table cover 124 includes a back portion 132 defining an outlet 134 between blade table cover 124 and blade table 90. As illustrated in FIG. 6, chambers 94 and 96 (not shown) are positioned on blade table 90 such that the inlet portions 101 of nozzles 100 are located partially within outlet 134 defined by blade table cover 124.

A panel of flexible material 136 such as felt or the like, as shown in FIGS. 5 and 6, surrounds outlet 134 of blade table cover 124 and inlet portions 101 of nozzles 100 to provide an air-tight seal between the blade table cover and the nozzles. Although not shown in FIG. 6, the panel of flexible material 136 has a plurality of apertures within which are located the inlet portions 101 of nozzles 100 of chambers 94, 96. The strip of flexible material 136 is secured at one end to the top surface 126 of blade table cover 124 by means of a plurality of back-up bars 138 and bolts 140. At the other end, the panel of flexible material 136 is secured to a side wall 141 of recessed portion 120 of blade table 90 by means of back-up bars 138 and bolts 140.

Referring to FIG. 6 in particular, the capture of solvent laden air according to the first embodiment of the present invention will be described.

As shown in FIG. 6, and as described earlier with respect to FIG. 3, air traveling in the direction of arrows D will be forced to travel along doctor blade 91 and the top surface 92 of blade clamp 93 towards inlet 130. Since the dryer exhaust fan 70 (FIG. 2) supplies a suction to chamber 94 and chamber 96 (not shown) and, therefore, to inlet portion 101 of nozzle 100, the solvent laden air is captured within inlet 130.

Once the solvent laden air is captured, it flows through ducts 97, 98, dryer exhaust duct 50 (FIG. 2) and then through the remainder of the exhaust system as described with respect to FIG. 2.

Figure 12:
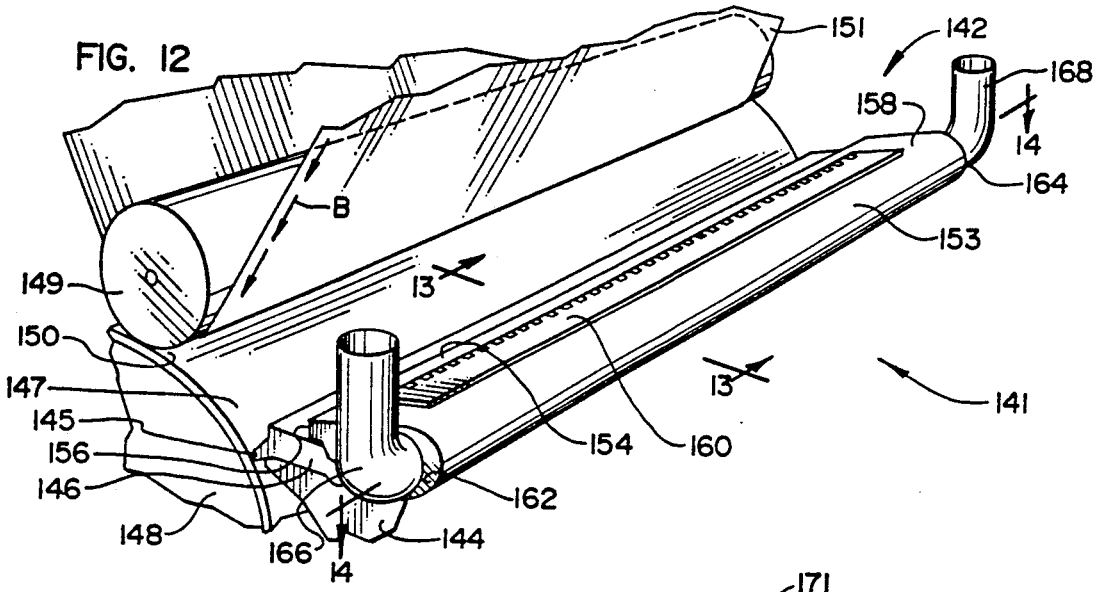
FIG. 12 is a fragmentary perspective view of a gravure press including a scavenger according to a second embodiment of the present invention.
Figure 13:
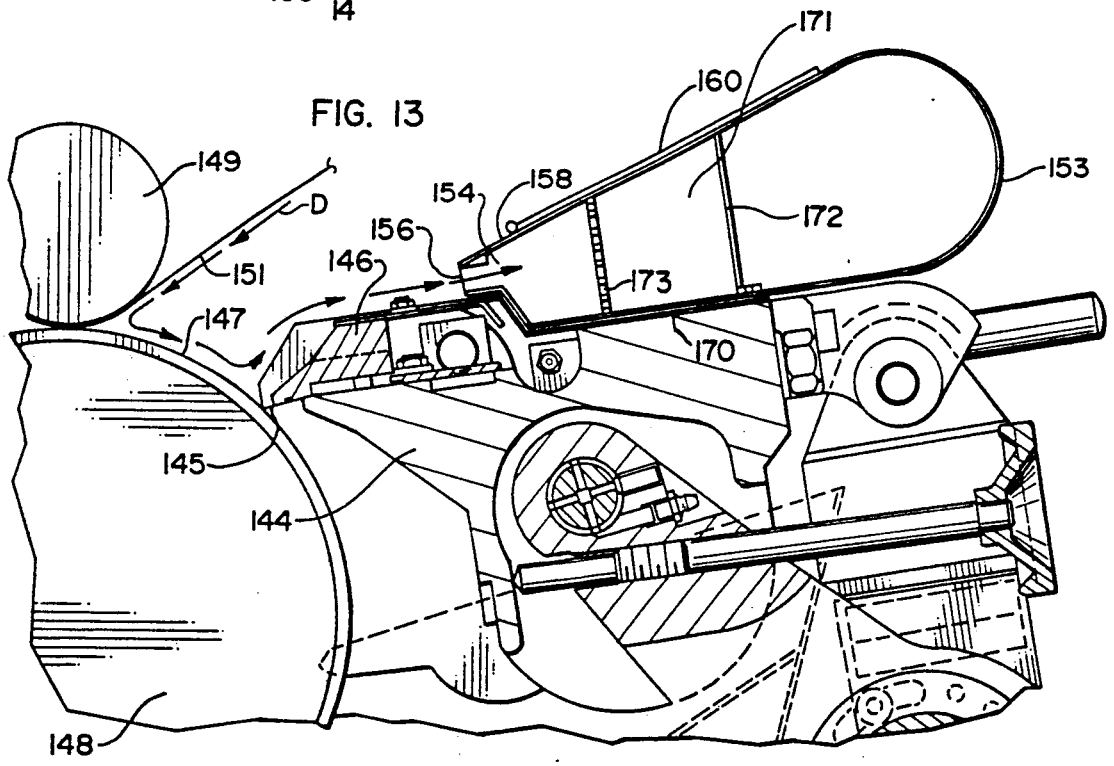
FIG. 13 is a fragmentary vertical sectional view, taken generally along line 13—13 of FIG. 12.
Figure 14:
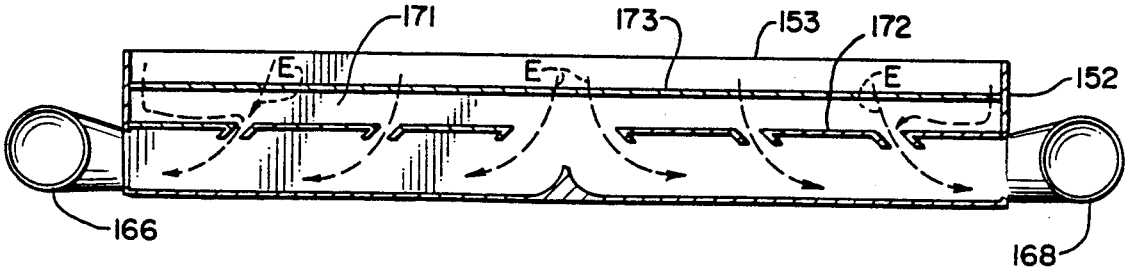
FIG. 14 is a horizontal sectional view of the scavenger according to the second embodiment of the present invention, taken generally along line 14—14 of FIG. 12.

A second embodiment of the invention, for an Albert press, is illustrated in FIG. 12–14. A scavenger, generally designated 142, is mounted on top of a blade table 144. A doctor blade 145 is mounted to blade table 144, by means of a clamp 146, for removing excess ink from an outer surface 147 of a cylinder 148. As shown therein, the printing press further includes an impression roller 149 forming a pinch 150 through which a web 151 travels in the direction of arrow B.

The scavenger 142 includes a chamber 153, extending the length of the cylinder 144, having an inlet portion 154 including an inlet 156 for the capture of solvent laden air.

As shown in FIG. 13, the chamber 153 includes a top surface 158 having an access panel 160 hingedly connected thereto. Still further, chamber 153 has side walls 162, 164 from which outlet ducts 166, 168 protrude. Although not shown in FIGS. 12 or 13, it is understood that the outlet ducts 166, 168 are connected to dryer exhaust duct 50 in a manner similar to that described with respect to FIG. 2.

As shown in FIG. 13, the chamber 153 is mounted on a top surface 170 of a recessed portion of blade table 144 such that the inlet portion 154 of chamber 153 is situated partially over the blade clamp 146. As shown in FIG. 13, and more particularly FIG. 14, the chamber 153 has an interior 171 within which an open area screen 173 and a baffle plate 172 is located. As shown in FIG. 14, baffle plate 172 is located within interior 171 of chamber 153 such that solvent laden air flows through screen 173 to outlet ducts 166, 168 in the direction of arrows E.

Referring to FIGS. 12–14, the capture of solvent laden air according to the second embodiment of the present invention will be described.

As shown in FIG. 13, and as described earlier with respect to FIG. 3, air traveling in the direction of arrows D will be forced to travel along the top surface of doctor blade 145 and blade clamp 146 towards inlet 156 of chamber 153. Since the dryer exhaust fan (FIG. 2) supplies a suction to chamber 153 and, therefore, to inlet portion 154 of inlet 156, the solvent laden air is captured within inlet 156.

Once the solvent laden air is captured, it will flow through screen 173, and baffle 171 in the direction of arrows E, through ducts 166, 168, dryer exhaust duct 50 (FIG. 2), and then through the remainder of the exhaust system as described earlier with respect to FIG. 2.

The above-described scavenger according to the invention provides several advantages.

First, the scavenger reduces between unit concentrations to a level of the order of 0–75 ppm. The prior art of FIG. 1 may have scavengers between unit concentrations from 75–625 ppm.

Further, when a pressman approaches the printing cylinder and uses a slur stick to remove foreign particles from the printing cylinder, his/her exposure to solvent from the ink is reduced from 600–1,500 ppm to 25–100 ppm.

Still further, the reduced concentration of solvent on the web from the use of the scavenger results in a reduced concentration of solvent in the dryer recirculation air stream, and a corresponding improvement in the performance of the dryer by increasing the concentration difference between the web and the air in the dryer.

Still further, the scavenger according to the present invention only requires 180 to 200 CFM of air to operate efficiently since it is located near the source of solvent laden air, whereas a prior art scavenger requires 400 to 600 CFM of air to operate efficiently since it is located remote from the source of solvent laden air. That is, since it is mounted several feet from the printing cylinder, the scavenger is forced to draw in an additional amount of air since the solvent in the air is more diffuse at that location.

Additionally, the scavenger enables the solvent recovery system to operate more efficiently with solvent concentrations therein of 1900–4000 ppm.

The foregoing detailed description is given for clearness of understanding only and no unnecessary limitations should be understood therefrom, as modifications will be obvious to those skilled in the art.

I claim:

1. In a gravure press, having a printing cylinder with a printing surface carrying a solvent-ink mixture, an impression roller forming a pinch with the printing surface of said cylinder, means directing a moving web through said pinch to transfer the solvent-ink mixture from the printing surface to the web.

a doctor blade and doctor blade table extending the length of said cylinder, adjacent said pinch with the doctor blade in engagement with the surface of the cylinder, and a blade table cover on said table, said blade table cover having a front portion defining a solvent inlet adjacent said cylinder and a back portion defining an outlet, an improved solvent scavenger, comprising:

a scavenger chamber on said doctor blade table;

plural discrete inlet nozzles extending forwardly from the scavenger chamber, over said doctor blade table and into the blade table cover outlet; and an exhaust duct connected with said scavenger chamber for exhausting solvent scavenged through said inlet nozzles.

2. The gravure press solvent scavenger of claim 1 including a panel of flexible material secured between said scavenger chamber nozzles and said blade table cover.

3. In a gravure press having a printing cylinder with a printing surface carrying a solvent-ink mixture.

an impression roller forming a pinch with the printing surface of said cylinder, means directing a moving web through said pinch to transfer the solvent-ink mixture from the printing surface to the web.

a doctor blade and doctor blade table extending the length of said cylinder, adjacent said pinch with the doctor blade in engagement with the surface of the cylinder, and a doctor blade clamp holding the doctor blade on the doctor blade table, an improved solvent scavenger, comprising:

a scavenger chamber on said doctor blade table with an inlet extending toward the cylinder over the doctor blade clamp, the inlet extending substantially the length of the press cylinder between the doctor blade and the pinch;

a screen inside the scavenger chamber inlet and extending the length of the chamber;

two exhaust ducts one at each end of said chamber for exhausting solvent scavenged through said inlet; and a baffle in said chamber, between said screen and said exhaust ducts, controlling air flow from said inlet to said exhaust ducts to equalize air flow along the length of said inlet.

* * * * *